United States Patent [19]

Govett

[11] Patent Number: 4,912,869

[45] Date of Patent: Apr. 3, 1990

[54] NET GUN

[75] Inventor: Peter Govett, Castle Hill, Australia

[73] Assignee: Tetra Industries Pty. Limited, Sefton, Australia

[21] Appl. No.: 265,995

[22] Filed: Nov. 2, 1988

[30] Foreign Application Priority Data

Nov. 2, 1987 [AU] Australia ..... PI5184

[51] Int. Cl.[4] ..... F41B 15/00

[52] U.S. Cl. ..... 42/105; 43/63; 89/1.11

[58] Field of Search ..... 42/105, 106, 77; 89/1.11, 14.05; 102/504; 43/59, 63

[56] References Cited

U.S. PATENT DOCUMENTS

| | | | |
|---|---|---|---|
| 8,528 | 11/1851 | Lemmer | 89/14.05 |
| 24,518 | 6/1859 | Jeffers | 89/14.05 |
| 1,217,415 | 2/1917 | Colomyjczuk | 89/1.11 |
| 1,229,421 | 6/1917 | Downs | 89/1.11 |
| 1,276,689 | 8/1918 | Poudrier | 89/1.11 |
| 1,418,964 | 6/1922 | Norman | 102/504 |
| 2,668,499 | 2/1954 | Mourlaque | 89/1.11 |
| 2,952,091 | 9/1960 | Blanchard | 102/504 |
| 3,505,926 | 4/1970 | Johnson | 102/504 |
| 4,559,737 | 12/1985 | Washington | 102/504 |

*Primary Examiner*—Charles T. Jordan
*Assistant Examiner*—Michael J. Carone
*Attorney, Agent, or Firm*—Oblon, Spivak, McClelland, Maier & Neustadt

[57] ABSTRACT

Disclosed is a net gun which utilizes a stock, an action member, a firing chamber, a manifold and a plurality of barrels connected to the manifold. Each of the barrels are adapted to receive a projectile which has an inner bore that is closely fitted over the external diameter of the barrel. Each barrel has a restrictor at the manifold end. A plurality of apertures are formed through the wall of the projectile adjacent to the barrel.

7 Claims, 6 Drawing Sheets

NET GUN

This invention relates to the capture of live animals by means of a physical restraint such as a net.

BACKGROUND OF THE INVENTION

The most common prior art method of catching live animals employs the use of a sedative or narcotic drug dart or syringe fired from a syringe projector. One disadvantage of such a system is that considerable knowledge of pharmacology and animal physiology is required for effective use of the dart.

Another prior art system utilises a long pole noose which suffers from the disadvantage that it places the operator in danger. Other prior art systems such as traps suffer from a similar disadvantage.

It is an object of the present invention to provide apparatus for the capture of live animals which permits the operator to remain at some distance from the target animal during capture.

BRIEF SUMMARY OF THE INVENTION

According to the invention there is provided a net gun comprising a stock, an action, a firing chamber, a manifold and a plurality of barrels connected to the manifold, each of said barrels being adapted to receive a projectile which has an inner bore that is a close fit over the external diameter of the barrel.

BRIEF DESCRIPTION OF THE DRAWINGS

In order that the invention may be more readily understood and put into practical effect, reference will now be made to the accompanying drawings in which.

DETAILED DESCRIPTION

Figure 1:
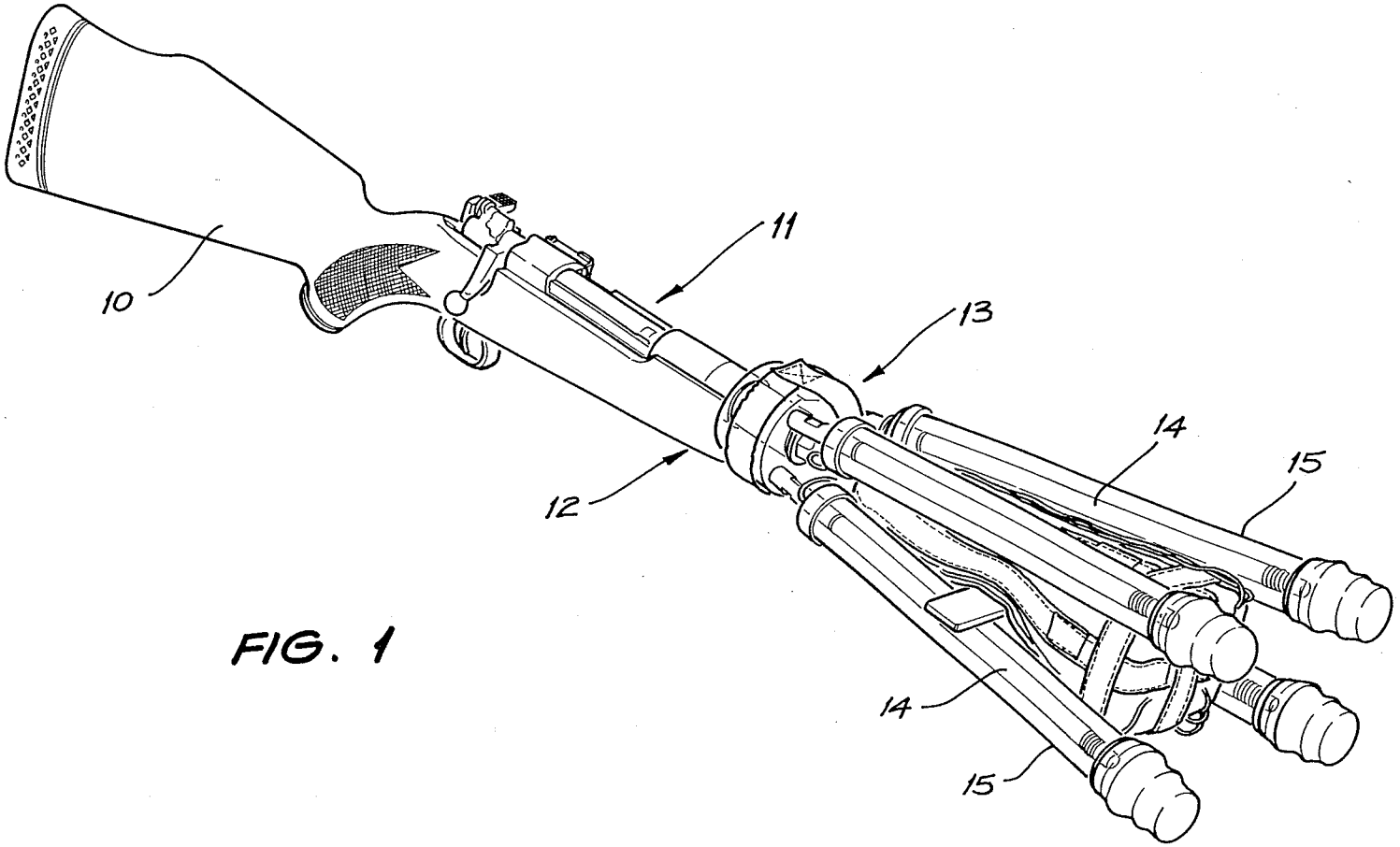
FIG. 1 is a perspective view of a net gun according to one embodiment of the invention.
Figure 2:
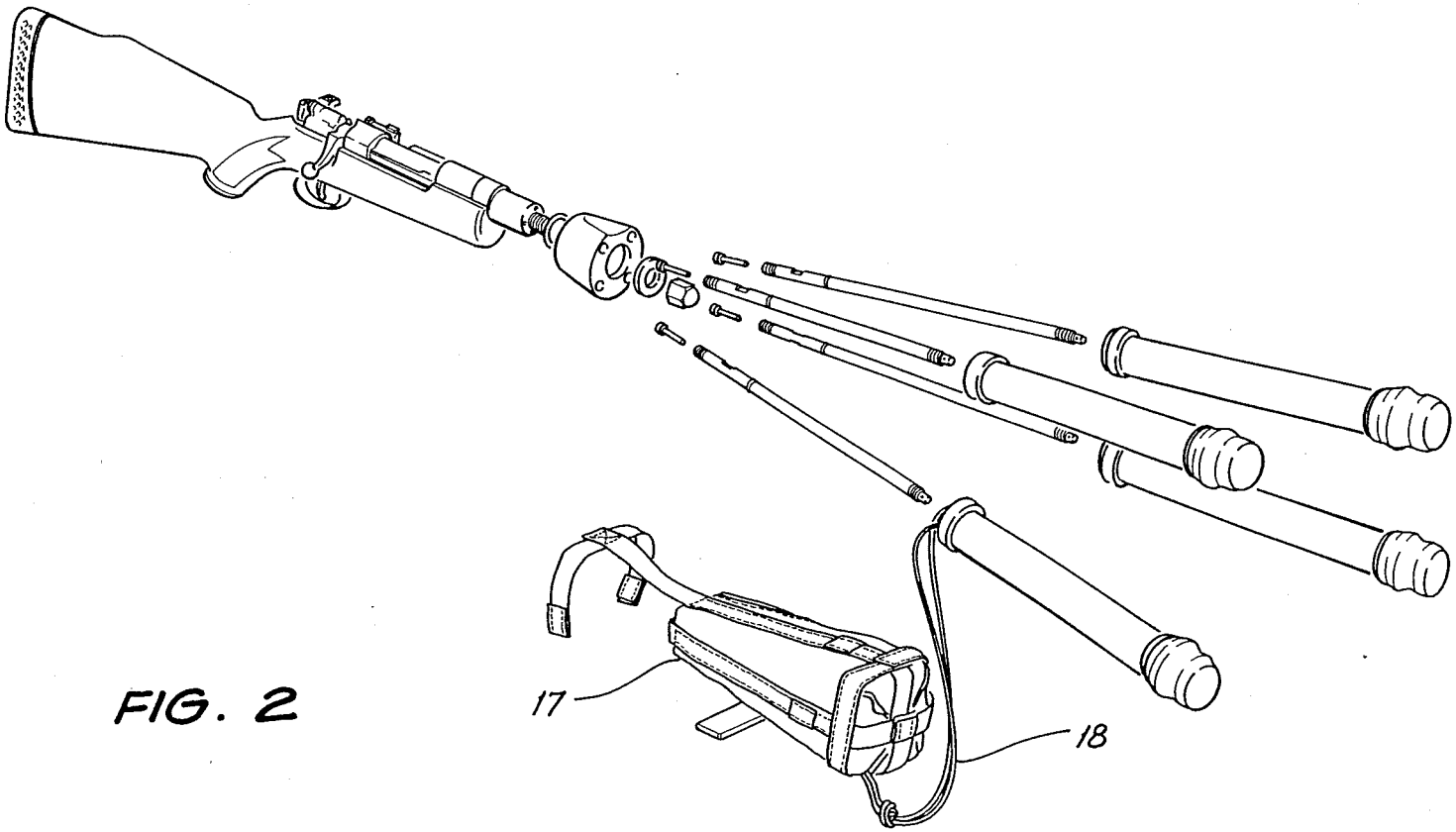
FIG. 2 is an exploded perspective view of the net gun shown in FIG. 2.

The net gun shown in FIG. 1 has five major components, a stock 10, an action 11, a firing chamber 12, a manifold 13 and a plurality of barrels 14.

The purpose of the stock 10 is to provide a safe and convenient means of handling and discharging the net gun. The stock 10 is made from any suitable material and may take the form of a conventional rifle stock. In such a case, the stock 10 is provided with a method of absorbing recoil shock such as a resilient pad, a spring or a hydraulic device.

In another embodiment of the invention, the stock 10 has two hand grips extending downwardly below the main body of the gun to allow the discharge of the gun while holding it away from the operator s body. Such an embodiment of the stock may be provided with a butt section.

The action 11 provides for the proper and safe loading of a blank charge as well as for discharge and ejection of the blank charge. In this instance, the action 11 is similar to the common bolt action of a rifle or shot gun but may be of any other convenient type. The action 11 may be a singleshot action or a magazine fed type. The action 11 is fitted with an integral safety catch.

The firing chamber 12 is made of steel or other suitable material and is formed so as to receive the blank charge but not to receive live ammunition.

The blank charge may be of the metal cased type or may be made of paper, plastic or other suitable material. Preferably, the blank charge consists of a brass case loaded with a suitable charge of propellent powder which is closed by means of crimping the case neck.

The firing chamber 12 has a short passage 20 leading from the mouth 21 of the blank charge to a number of radially arranged holes 22 which lead to the outside diametral surface of the firing chamber. The outermost ends of these holes may be connected by a groove 23 running around the outside surface of the chamber body 24. The sizing of the passage, the radial holes and the circular groove is critical to the efficient operation of the net gun.

The firing chamber 12 and the manifold 13 are connected together by a seal plate 25 and nut 26. Gas sealing between the firing chamber 12 and the manifold 13 is achieved by means of "O" ring seals or any suitable alternative.

The manifold 13 is made of steel or other suitable material and has an axial bore 27 which is a close fit over the firing chamber 12.

The manifold 13 has an annular recess 28 into which a number of orifices 29 are joined at various angles. In this instance there are four orifices 29 and each orifice is so formed at its outer end to receive a barrel 14.

In the preferred embodiment of the invention, the orifices are arranged such that when the barrels are fitted into the orifices, the barrels are at diverging angles to one another with the lower pair of barrels being at a greater angle than the upper pair to ensure proper unfolding of the net. The size of the entry to each orifice may be different so that varying degrees of resistance are offered to the free passage of gas through each such orifice 29 and thus to the respective barrels 14.

The groove 23 and annular recesses 28 may be replaced by a pattern of radial holes such that when the manifold is fitted over the firing chamber, the radial bores in the firing chamber align with the radial holes of the manifold.

In this embodiment of the invention, each barrel 14 has a restrictor 30 which balances the flow of the propulsive gases to each barrel 14. The restrictors 30 are made from steel or other suitable material and are formed with a stem or body 31 that is a close fit in the bore of the barrel and a head or flange 32 of a larger diameter. The restrictors 30 are fitted into the bores of each barrel prior to the assembly of the barrel 14 to the manifold 13 with the flanges of the restrictors being clamped immovably between the end of the barrel and the manifold.

The barrels 14 are made from steel tubing or any other suitable material and have any suitable outside diameter, bore diameter and length. One end of each barrel 14 is secured in the orifice 29 so as to be a gas tight fit with the orifices in the front face of the manifold. The muzzle of each barrel may be opened or restricted or be of any other suitable configuration.

In this embodiment of the invention, the barrels 14 are provided with a screw thread 32 which fits into a matching thread 33 in the orifices in the front face of the manifold 13 so as to be replaceable. The restrictors 30 if used, are fitted into the threaded end of the barrel before fitment to the manifold. The restrictors may vary from barrel to barrel so that the amount of restriction offered to the passage of gas is different for each barrel.

In one form of the invention, each barrel 14 is closed off at the muzzle end by an end wall 34 and the gas escapes through one or more apertures 35 made through the wall of the barrel.

Provision may be made for the fitment of one or more gas seals to the exterior surface of the barrels to effect a gas tight seal between the barrel and the projectile. A series of circular grooves 36 may be made around the periphery of each barrel 14 adjacent to the muzzle end for the purpose of retarding gas escape between the barrel and the projectile.

The projectile 15 is made from any convenient material such as steel, plastic or aluminium. The internal bore of the projectile 15 is a close fit over the external diameter of the barrels 14 and is held in place by 0-ring 37. A shock absorbing material or device 38 is fitted at the leading end of the projectile 15. The trailing edge of the projectile 15 is connected to the net 17 by means of the traces 18.

In this embodiment of the invention a number of apertures 39 are formed through the wall of the projectile adjacent to the barrel end and an outer sleeve or housing 40 is fitted over the body of the projectile. The purpose of the apertures 39 and the sleeve 40 is to eliminate the risk to the operator of high pressure gas blast following the firing of the gun.

Figure 4:
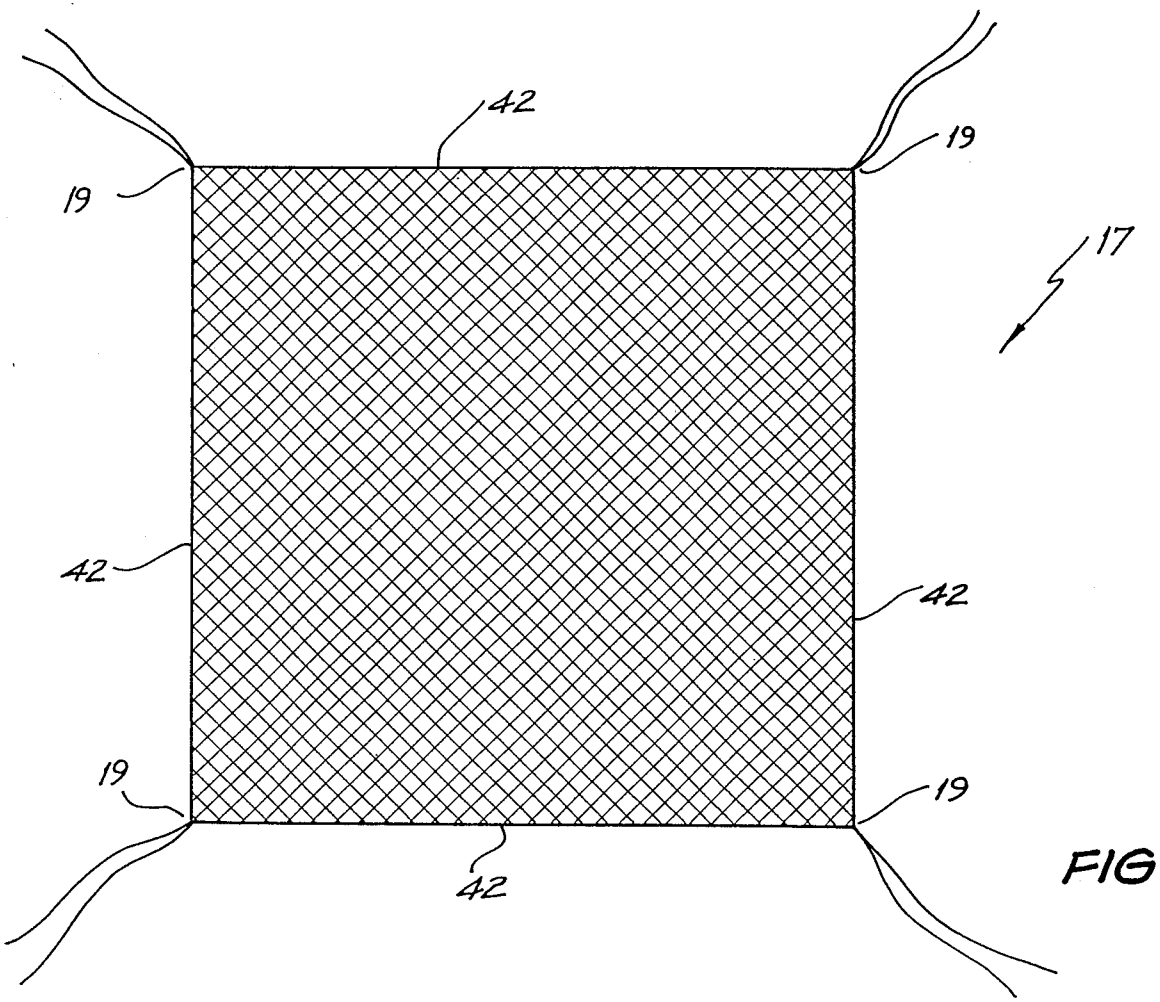
FIG. 4 is a plan view of the unfolded net.
Figure 5:
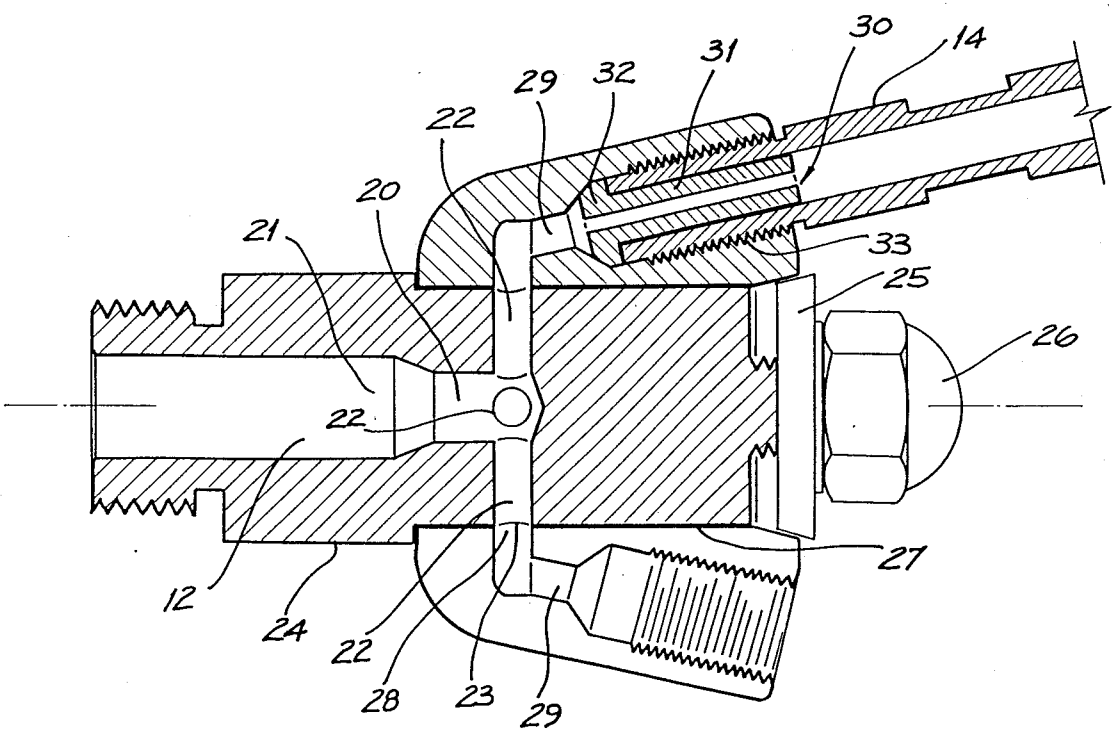
FIG. 5 is a cross-sectional view of the chamber, manifold and barrel showing the gas path, and, FIG. 6 is a cross-sectional view of the net weight in place on a barrel of the net gun shown in FIG. 1.
Figure 6:
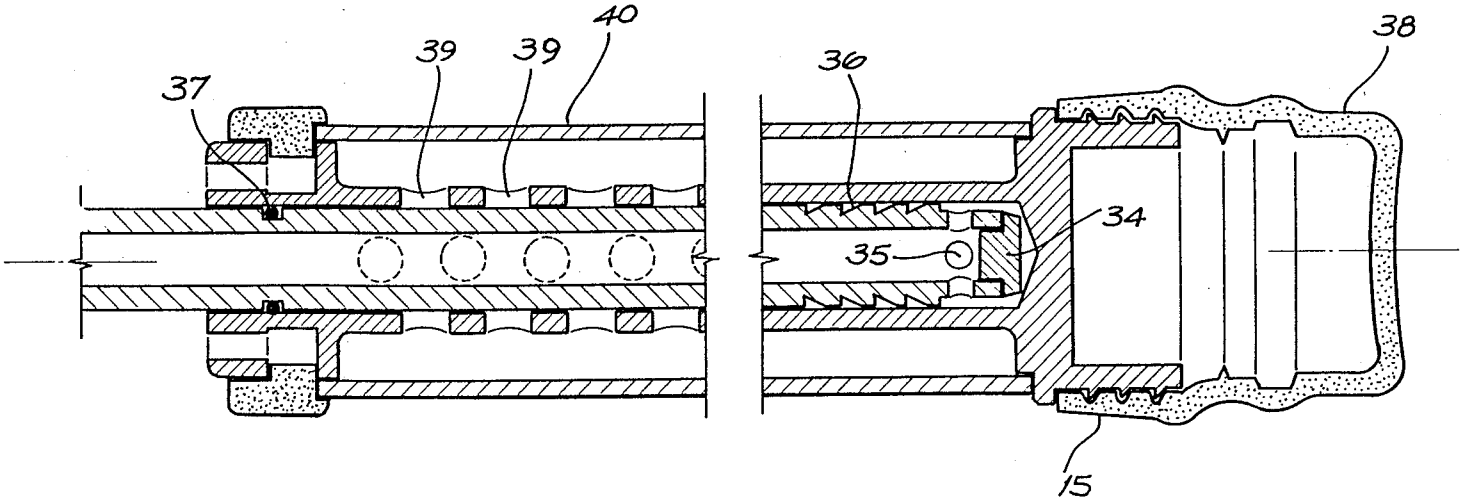

The net 17 (see FIG. 4) is constructed by tying or joining at the points of intersection two or more layers of a number of parallel lengths of line placed at an angle to each other so as to form a mixed fabric. A variety of sizes of mesh may be provided to accommodate animals of different sizes.

The net 17 may be of any convenient shape such as square or rectangular. In the embodiment shown in FIG. 4, the individual filaments or fibres that intersect the center point of the body of the net run from adjacent to one weight attaching point 19 to a point adjacent to the diagonally opposite weight attaching point 19.

The mesh portion of the net is attached to perimeter cords 42 which are joined to each other at the corners of the net. The traces 18 may be of a material similar to that of the net and/or its perimeter cords 42 or of any other material. Suitable devices may be fitted to the traces to allow the ready attachment and release of the projectiles from the net without the use of a special tool.

Figure 3:
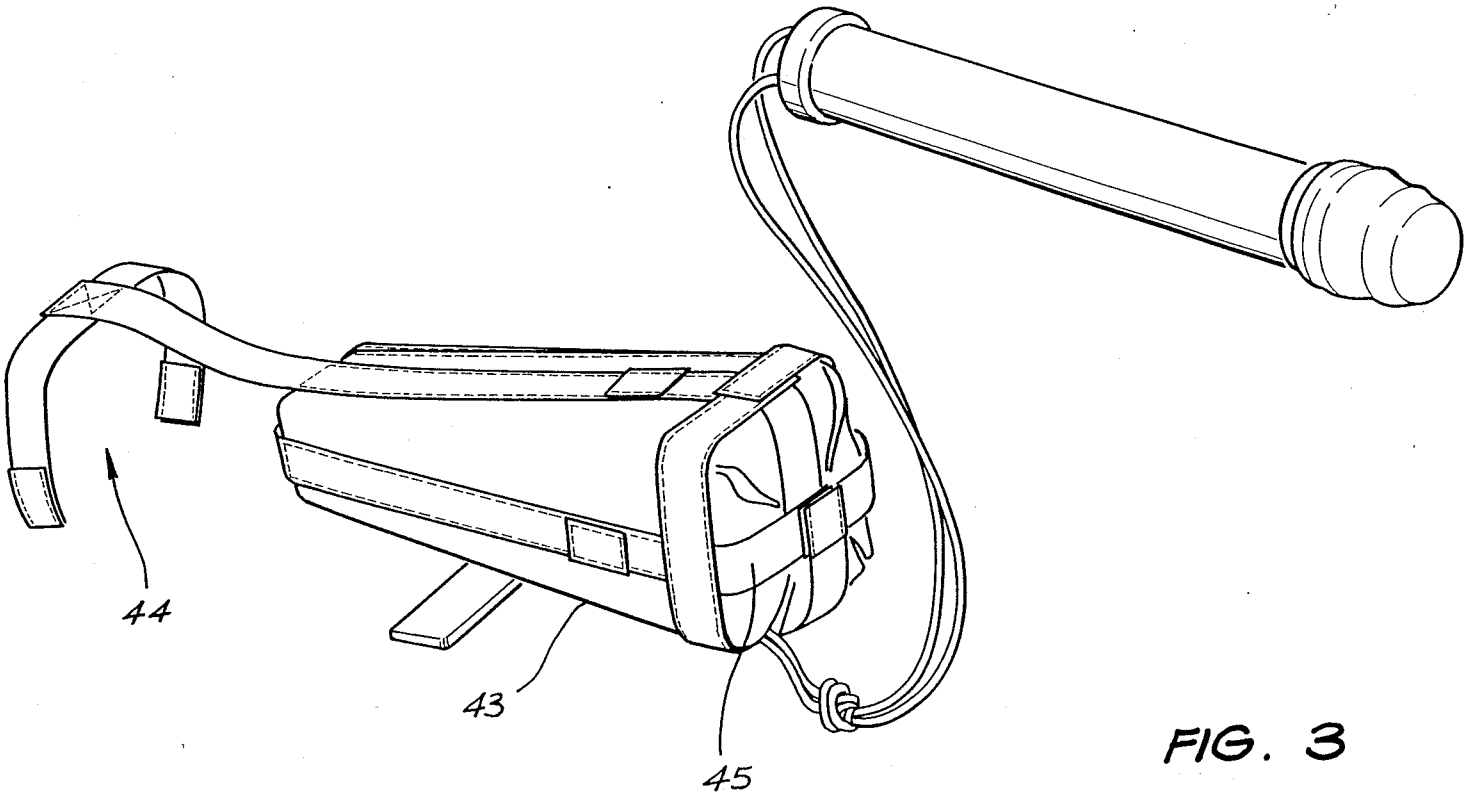
FIG. 3 is an enlarged perspective view of the packaged net of the net gun shown in FIG. 1.

To allow for convenient carrying of the net and the correct deployment of the net after firing of the gun, the net is confined in a container 43 as shown in FIG. 3. In this instance, the loaded container 43 is located within the confines of the plurality of barrels.

The container may be made of any suitable material and may be of a cross-sectional shape which tapers from the front to the rear. The rear end of the container 43 is provided with a means 44 of attachment to the gun and the front opening has a closure formed by one or more flaps or straps 45. These flaps or straps are fitted with fastening so that when closed the net is retained within the container but on firing of the gun, the emerging net can easily release the fastenings. The closure device may be a separate cover fastened to the container in such a way that upon firing of the gun the fastenings release and the cover is jettisoned.

In a preferred form of the invention, the container 43 is made from a heavy fabric such as canvas and is in the form of a truncated cone. Four segmental flaps of a similar material extend forward so that when folded over the base of the bag the flaps cover the base. Four straps of a woven webbing material are sewn along the length of the main body of the container along the centre line of the flaps.

The straps, when folded over the base of the container, overlap by a small amount and the overlapping portions are fitted with a material such as VELCRO.

In order to load the net 17 within the container 43, the net is first spread out onto a flat surface with the projectiles attached to the corners. The centre of the net is then drawn to one side and the tail thus formed is pushed down into the bottom of the container and the rest of the net is drawn up in the form of a progressively larger tube and folded in a zig-zag fashion into the container leaving the traces trailing.

When the entire net is in the container, the retainer disc is placed over the net and the traces are led through the slots in the disc. The flaps are then folded over the disc with the traces placed so that one trace leads out between each pair of flaps. The net container is then placed between the two lower barrels and the projectile weights are fitted over the barrels and pushed down onto them.

Various modifications may be made in details of design and construction without departing from the scope and ambit of the invention.

I claim:

1. A net gun comprising a stock, an action, a firing chamber, a manifold and a plurality of barrels connected to the manifold, each of said barrels being adapted to receive a projectile which has an inner bore that is a close fit over an external diameter of the barrel.

2. A net gun according to claim 1 wherein said plurality of barrels comprise four barrels disposed as an upper pair and a lower pair of barrels.

3. A net gun according to claim 2 wherein the barrels of the upper pair and the barrels of the lower pair are divergent to one another.

4. A net gun according to claim 3 wherein the lower pair of barrels are at a greater angle to each other than the upper pair of barrels.

5. A net gun according to claim 1 wherein each barrel has a restrictor at the manifold end.

6. A net gun according to claim 5 wherein the restrictors of the upper pair of barrels have different bores to the restrictors of the lower pair of barrels.

7. A net gun comprising a stock, an action, a firing chamber, a plurality of projectiles, a manifold and a plurality of barrels connected to the manifold, each of said barrels being adapted to respectively receive said plurality of projectiles having an inner bore that is close fit over an external diameter of the barrel wherein a plurality of apertures are formed through a wall of the projectile adjacent to the barrel.

* * * * *